US008910503B2

(12) United States Patent
Wiklund et al.

(10) Patent No.: US 8,910,503 B2
(45) Date of Patent: Dec. 16, 2014

(54) TOOL ARRANGEMENT WITH A PROTECTIVE NON-WOVEN PROTECTIVE LAYER

(75) Inventors: Daniel Wiklund, Vastra Frolunda (SE); Anders Bergner, Halmstad (SE); Pernilla Valkenstrom Sundberg, Kullavik (SE); Boel Wadman, Vastra Frolunda (SE); Lars-Olof Ingemarsson, Kungsbacka (SE)

(73) Assignee: Swerea IVF AB, Molndal (SE)

( * ) Notice: Subject to any disclaimer, the term of this patent is extended or adjusted under 35 U.S.C. 154(b) by 0 days.

(21) Appl. No.: 14/111,808

(22) PCT Filed: Apr. 13, 2012

(86) PCT No.: PCT/EP2012/056819

§ 371 (c)(1), (2), (4) Date: Nov. 5, 2013

(87) PCT Pub. No.: WO2012/140221

PCT Pub. Date: Oct. 18, 2012

(65) Prior Publication Data

US 2014/0053624 A1 Feb. 27, 2014

(30) Foreign Application Priority Data

Apr. 15, 2011 (SE) ..... 1100283

(51) Int. Cl.

| | |
|---|---|
| ***B21D 22/02*** | (2006.01) |
| ***B21D 22/10*** | (2006.01) |
| ***B21D 37/01*** | (2006.01) |
| ***B21D 22/00*** | (2006.01) |

(52) U.S. Cl.

CPC ..... *B21D 37/01* (2013.01); *B21D 22/00* (2013.01)

USPC ..... 72/465.1; 72/466.8; 72/63; 72/379.2

(58) Field of Classification Search

USPC ..... 72/57, 63, 379.2, 389.3, 414, 465.1, 72/466.8

See application file for complete search history.

(56) References Cited

U.S. PATENT DOCUMENTS 2,293,184 A * 8/1942 Weissert ..... 72/389.2
4,689,979 A 9/1987 Otsuka et al.

(Continued)

FOREIGN PATENT DOCUMENTS

GB 2151527 A 7/1985
JP S63144034 A 6/1988

(Continued)

OTHER PUBLICATIONS

International Search Report PCT/ISA/210 for PCT/EP2012/056819 dated Jun. 4, 2012.

(Continued)

*Primary Examiner* — David B Jones

(74) *Attorney, Agent, or Firm* — Harness, Dickey & Pierce, P.L.C.

(57) ABSTRACT

The present invention relates to the use of an adaptive protective textile (3) in sheet metalforming, comprising non-woven material which is draped over the active surfaces of the sheet metalforming tool (2), wherein the surfaces of the sheet metal (4) are protected from contact with the surfaces of the tool (2) and the need for lubricant is eliminated.

13 Claims, 3 Drawing Sheets

(56) References Cited

U.S. PATENT DOCUMENTS

| | | | | |
|---|---|---|---|---|
| 4,795,998 | A | 1/1989 | Dunbar et al. | |
| 5,054,196 | A * | 10/1991 | Sakaya et al. | 72/368 |
| 5,081,861 | A * | 1/1992 | Miura | 72/462 |
| 5,542,282 | A * | 8/1996 | Muldner | 72/414 |
| 5,887,475 | A * | 3/1999 | Muldner | 72/379.2 |
| 6,865,917 | B2 | 3/2005 | Golovashchenko et al. | |
| 2002/0186007 | A1 | 12/2002 | Cao et al. | |
| 2006/0137424 | A1 | 6/2006 | Browne et al. | |

FOREIGN PATENT DOCUMENTS

| | | | |
|---|---|---|---|
| JP | H11129032 | A | 5/1999 |
| JP | 2006272631 | A | 10/2006 |
| JP | 2009136906 | A | 6/2009 |
| SU | 1719130 | | 3/1992 |
| WO | WO-2011036688 | A1 | 3/2011 |

OTHER PUBLICATIONS

International Preliminary Report of Patentablity PCT/IPEA/409 for PCT/EP2012/056819 dated Jun. 11, 2013.

Swedish Office Action dated Oct. 19, 2011 issued in corresponding Swedish Appin. No. SE 1100283-9.

* cited by examiner 10a
11
12

10b
12
11

10c
13
11
12

10d
11

TOOL ARRANGEMENT WITH A PROTECTIVE NON-WOVEN PROTECTIVE LAYER

CROSS-REFERENCE TO RELATED APPLICATIONS

This application is the national phase under 35 U.S.C. §371 of PCT International Application No. PCT/EP2012/056819 which has an International filing date of Apr. 13, 2012, which claims priority to European patent application number 1100283-9 filed Apr. 15, 2011.

TECHNICAL FIELD

The present invention relates to a tool arrangement for metal working, for example metal forming, such as stamping, stretchforming, deep drawing, bending, etc., wherein a workpiece made of sheet metal, for example, is shaped by one or more tool parts.

PRIOR ART

In sheet metal forming, forming tools which control the deformation and displacement of the sheet metal while in contact therewith are normally used. The tools consist of recesses (concave dies) and protrusions (convex dies) having geometries which recreate the desired final geometry, with compensation for spring back and variations in sheet metal thickness during the forming. The tools have a weight which often exceeds one metric ton, and are pressed with hydraulic, electric or mechanical presses at hundreds of kN against the workpiece until the desired deformation occurs. The contact pressures acting between tool and sheet metal are often very large. The pressure, together with the movement of the sheet metal over the tool surface, causes adhesion, micro welding and/or wear of the tool material, which can lead to scratches and surface defects on the finished component.

In order to reduce wear on both tools and sheet metal surfaces, lubricant is often used in the forming. Large resources are invested in improving the internal and external environment in the sheet metal forming industry by reducing the use of these lubricants.

One solution is to separate sheet metal and tool with a protective layer, which can consist of either hard layers, which are applied directly to the tool, loose polymer films, which are placed between sheet metal and tool, or dry lubricants, which are laid on the sheet metal surface.

The hard layers can consist of nitration, hard chrome plating and laser treatment, supplied under heat, which can adversely affect the surface smoothness or external shape of the tool. Alternative methods such as PVD and CVD layers, as well as low-friction layers of, for example, Diamond Like Carbon, require a smooth tool surface in order to work satisfactorily and thus entail increased costs both for surface modification and surface coating.

Of loose protective films there are many variants. In simpler two-dimensional forming, such as edge bending, different variants of protective plastic or textile are used as a protective covering between sheet metal and bending tool, see U.S. Pat. No. 5,542,282 and U.S. Pat. No. 5,887,475.

In three-dimensional forming of products having a sensitive surface, such as sinks, etc, of stainless steel, it is common practice to cover the sheet metal with a polymer film, which may also be lubricated. This film is a single use product which remains in place on the shaped component and also acts as a scratch protection during transport, up to installation and usage.

Dry lubricants can be coated on the sheet metal in sheet metal production or prior to the forming. Dry lubricants work according to different principles. The most common principle involves thin flakes which slide one upon another. Typical examples of this are molybdenum disulphide, boron nitride and graphite.

Another common dry lubricant is PolyTetraFluoroEthylene (PTFE), which is a thermoplastic having extremely low friction and low surface energy. PTFE can be used in many different ways to reduce friction: as a fine powder, dispersed in a liquid, or as a sintered surface coating. One of the disadvantages with PTFE is that the material is soft and does not stand up particularly well to abrasion. Another disadvantage is low thermal conduction, which, together with a maximum usage temperature of about 260° C., limits the use in processes in which local heating on a microscale can break down the surface in the material and increase the friction properties.

The above-described techniques have the following limitations:

i) Hard layers on tools entail an increased cost with respect to tool production. In most cases, lubricant is required in the forming.

ii) Forming with plastic-coated sheet metal or dry lubricants is a single use solution which produces extra costs and environmental pollution, since the film/lubricant cannot be reused. The plastic can replace lubricant in forming operations which do not exceed the elongation limit of the plastic, otherwise lubricant is required here also.

iii) Protecting the tools with various protective materials according to U.S. Pat. No. 5,542,282 and U.S. Pat. No. 5,887,475 comprises only simple forming in two dimensions.

There is therefore great need achieve an improved tool arrangement for metal working, which allows more effective and more complex working with high product quality, and which may be utilized for repetitive use in an efficient manner.

BRIEF SUMMARY OF THE INVENTION

The object of the present invention is to eliminate or at least partially alleviate the above-stated disadvantages of the prior art, and to achieve an improved tool arrangement for metal working, which allows more effective and more complex working. This is achieved according to one aspect of the present invention by a tool arrangement for cold metal working, comprising a tool which has at least one forming surface, which is arranged to shape a workpiece during a working process according to a three-dimensional pattern or shape comprising a double curvature surface, wherein the forming surface of the tool is provided with a protective layer which is intended to be situated between the forming surface and the workpiece in order to protect the tool and/or the workpiece during the working process, wherein the protective layer comprises, is formed of, or consists of a bonded fiber fabric or non-woven material, or a non-woven fiber fabric.

One advantage of the invention is to minimize surface problems in sheet metal forming and to eliminate or at least minimize the quantity of lubricant used in sheet metal forming of three dimensional products.

According to one embodiment, this is achieved by virtue of the fact that textiles comprising bonded fiber fabric or non-woven material of a certain quality are used as protective covering on the forming tools, either on one or both sides of the sheet metal. A draped tool can be achieved, for example, by the textile being draped over the tools and fixed with a device such that the textile is shaped with the sheet metal during the working process. The protective textile remains on the tool after the forming and can be reused in a number of forming operations.

One function of the textile is to prevent contact between the workpiece, such as sheet metal, and the tool. This means that lubricant can be wholly avoided in those cases where both sides of the sheet metal are protected, and partially avoided where one sheet metal side is protected by textile.

In addition, it is also made possible for tool maintenance and washing to be minimized, which, for example, is important in the forming of sheet metal which sticks to the tools, for example stainless steel sheet metal, titanium, aluminum and galvanized sheet metal.

For example, the tool arrangement for working/forming metal is arranged for cold metal forming wherein no external heat is required. Thereby a more efficient metal working process may be provided. For example, the forming surfaces of the tool, such as female and male dies and forms adapted for shaping the metal workpiece by pressing action in a press, are operated at room temperature, or at about room temperature, and/or without any additional provisition of heat from external heat sources, such as electric heating device used for heating the workpiece during hot metal forming. Also, the workpiece may be processed without any heating or provision of heat from external heat sources. For example, according to an embodiment, the tool arrangement and the method for metal working involves metal processing at a temperature not above 200, or not above 120, or not above 100 degrees Celsius, or at about room temperature.

According to an exemplifying embodiment, the bonded non-woven fiber fabric forming the protective layer comprises UHMW-PE (Ultra High Molecular Weight PolyEthylene) fibers. For example, according to various embodiments, the non-woven fiber fabric comprises at least 50% by weight of UHMW-PE fibers, or at least 60%, or at least 70% or at least 80%, or at least 90% by weight of UHMW-PE fibers. Thereby, depending on the application, suitable fiber content in the non-woven fiber fabric may be provided. According to a further exemplifying embodiment, the bonded non-woven fiber fabric is formed of fibers, or staple fibers, having a length between 20 and 100 mm, or between 40 and 80 mm, or between 50 and 60 mm. Thereby, a fiber fabric may have sufficient strength and internal non-woven bonding which is advantageous in that a durable and long lasting protective layer is provided.

According to an exemplifying embodiment, the bonded non-woven fiber fabric is draped over the forming surface of the tool and reshaped during the working process. Hence, the protective layer may advantageously be adapted to and formed into conformity with the forming surface during the working process, which improve the surface finish of finished workpiece products during repetitive forming operations by forming a contact surface having high surface finish. Advantageously, the protective layer may be reshaped and stretched out to conform with three-dimensional shaped comprising a double curvature surface to form a flat protective surface without folds or wrinkles. In other words, the bonded non-woven fiber fabric forms an adaptive protective layer which adapts to the complex forming surface in a folding free and wrinkle free manner.

According to an exemplifying embodiment, the tool arrangement is configured to shape the workpiece according to the three-dimensional shape comprising the double curvature surface in a simultaneous manner. For example, bends of the double curvature surface as advantageously formed in a single efficient process while being protected by the protective layer.

According to a further exemplifying embodiment, the protective layer is self-supportive and shaped according to the forming surface during the working process, such that the protective layer is shaped into essentially the same shape and/or cross-sectional profile as the forming surface. Thereby, the protective layer is self-adaptive and less equipment is required in order to ensure the correct alignment of the protective layer in relation to the forming surface since the self-supportive structure of the protective layer will strive to align with and maintain in correct orientation in relation to the forming surface.

Without being bound to this theory, it is believed that the pressing of the non-woven fiber fabrics results in bonds on the molecular level, such as covalent bonds, which contribute to the self-supportive feature, such that the protective layer maintains it reshaped shape after e.g. an initial forming process operation.

Moreover, according to an exemplifying embodiment, the forming surface of the tool has a configuration which is arranged to shape the workpiece according to the three-dimensional pattern or shape. For example, the configuration of the forming surface comprises at least one recess, which is intended to receive and shape a part of the workpiece during the working process. Additionally or alternatively, the configuration of the forming surface comprises at least one protrusion, which is intended to shape the workpiece during the working process. Furthermore, according to an embodiment, the recesses and protrusions of the forming surface form the three-dimensional pattern or shape of the forming surface, wherein in the protective layer is a continuous layer which covers said recesses and protrusions.

According to an exemplifying embodiment of the tool arrangement, the protective layer is arranged for repetitive use involving forming a plurality of separate workpieces or forming operations without the need to be exchanged. For example, the plurality of separate workpieces or forming operations comprises at least 10, or at least 25, or at least 50, or at least 100, or at least 500 separate workpieces or forming operations, which allow for more efficient and cost effective metal forming operations.

According to an exemplifying embodiment, the workpiece is formed of sheet metal. For example, according to various embodiments, the tool arrangement is arrange for forming a workpiece having a thickness between 0.1 and 5 mm, or between 0.3 and 3 mm, or between 0.5 and 2 mm.

Furthermore, according to an exemplifying embodiment, the bonded non-woven fiber fabric has a weight between 50 and 1000 grams per square meter, or between 100 and 400 grams per square meter, or between 200 and 300 gram per square meter. Thereby, a durable protective layer having suitable protective and reshaping properties may be provided.

According to an exemplifying embodiment, the three-dimensional pattern or shape comprises a second double curvature surface being different from the first double curvature surface, thereby forming a more complex three-dimensional shape. For example, the first and second double curvature surface are different in that they comprise first and second bends having differing, or non-coinciding normal directions.

According to yet an exemplifying embodiment of the tool arrangement, the textile, i.e. the protective layer, contains transmitter functions which can be used to measure and quality control the process employed in sheet metal forming.

According to various embodiments of the tool arrangement, it may be used in the forming of sheet metal which acts adhesively on a metallic tool surface, for example sheet metal made of stainless steel, titanium, aluminum, magnesium and galvanized or high-strength steel sheet metal. Furthermore, according to one embodiment, the tool arrangement is arranged for use in the forming of polymer-coated sheet metal. The tool arrangement may also, according to various embodiments, be arranged for use in the forming of surface-structured sheet metal, or for use in the forming of high-polished or smooth-rolled sheet metal. The tool arrangement may also be arranged for use in the forming of sheet metal having other surface treatment which risks being damaged in conventional pressing.

According to yet an exemplifying embodiment, the tool arrangement is arranged for use in the forming of sheet metal in tools having lower surface fineness than usual without worsened surface fineness finish on the formed part. In other words, the tool arrangement may be arranged for use in forming of sheet metal with tools having higher surface roughness than usual without worsened surface finish on the formed part. Also, according to an embodiment, the tool arrangement is arranged for use in the forming of sheet metal in tools having lower surface hardness than usual without worsened tool service life.

According to an additional exemplifying embodiment, the tool arrangement further comprises a second tool having a second forming surface facing and arranged to cooperate with the forming surface of the first tool for forming a workpiece between the first and second forming surfaces according to the three-dimensional pattern or shape. Furthermore, the tool arrangement may, according to an embodiment, comprise a second protective layer arranged according to the first protective layer, which second protective layer is arranged between the workpiece and the second forming surface.

According to another aspect of the present invention, it relates to a method for the working of metal, in which a workpiece is formed in a working process according to a three-dimensional pattern or shape comprising a double curvature surface with a tool which has at least one forming surface, wherein the forming surface of the tool is provided with a protective layer comprising bonded non-woven fiber fabric, the layer being arranged between the forming surface and the workpiece in order to protect the tool and/or the workpiece during the working process. The method is advantageous in that provides improved and more efficient manufacturing of metal forming of a metal workpiece, allowing for reduced surface problems and to eliminate or at least reduce the quantity of lubricant used in sheet metal forming of three dimensional products. The method is further advantages in similar manner as described in relation to the tool arrangement according to the present invention, and as further described in this document. Also, no external heat is required and a more efficient metal working process may be provided.

According to an exemplifying embodiment, the method further comprises shaping the bonded non-woven fiber fabric during the working process, wherein at least a portion of the protective layer is extended such that the protective layer conforms to the forming surface. Thereby, the protective layer is advantageously adapted during the working process, independent of the shape or structure of the forming surface.

According to an exemplifying embodiment, the protective layer is shaped between the forming surface of the tool and the workpiece. The protective layer is further, according to an embodiment, shaped into a self-supportive structure corresponding with the forming surface of the tool. For example, the protective layer is formed of a separate sheet arranged between the tool and the workpiece.

According to an exemplifying embodiment, the method comprises a first step in which the protective layer, having an essentially flat shape, is compressed and between the forming surface of the tool and the workpiece, or between the forming surface of the tool and a second tool, such that the protective layer is reshaped to conform to the forming surface. For example, according to an embodiment, the first step comprises arranging the protective layer in a flat outstretched configuration.

According to an exemplifying embodiment, the method further comprises a second step in which an additional workpiece to be formed in the working process is formed according to the three-dimensional pattern or shape with the tool, wherein the same reshaped protective layer is arranged between the forming surface and the workpiece in order to protect the tool and/or the workpiece during the working process. For example, according to an embodiment, the second step may be repeated a number of times for a plurality of separate workpieces or forming operations.

According to a further exemplifying embodiment of the method, the reshaped protective layer is reshaped to extend into and conform with an inwardly extending cavity of the forming surface of the tool, wherein the reshaped protective layer is self-supportive such that it remains in an inwardly extended and conformed configuration in relation to the inwardly bent cavity of the forming surface. Furthermore, the protective layer may advantageously be arranged to remain in an inwardly extended and conformed configuration in relation to the inwardly bent cavity of the forming surface during a number of repeated second steps. Also, according to an embodiment, the bonded non-woven fiber fabric may advantageously be compressed to form a self-supportive structure during the working process. According to one embodiment, the invention can also be used to form sheet metals having an extra sensitive surface, such as polymer-coated sheet metal and bright-annealed sheet metal and sheet metal having a structured surface.

One possibility is to use textile materials, such as non-wovens. Non-wovens is a collective term for the production of textile materials which are not produced by weaving, knitting or other methods which require continuous yarn or thread for production.

According to an exemplifying embodiment, the working process of the tool arrangement involves gliding, or sliding, movement of the workpiece in relation to the forming surface of the draped tool, while the workpiece is shaped into conformity with the forming surface of the tool. Furthermore, the protective layer may be reshaped during the working process, which reshaping comprises stretching/extending the bonded non-woven fiber fabric in its plane According to an embodiment, the non-woven fiber fabric, also referred to as the textile, is formed by carding and needling techniques. For example, carding straightens and separates the fibers which are to form the fiber fabric. Needling, using e.g. a needlepunch machine, provides strength and dimensional stability to the fiber fabric. The needling may be arranged to make the fiber fabric sufficiently thin, stiff and/or strong. For example, needling using needle punching is carried out by passing a high number of needles, typically provided with barbs, mounted in a board, through the fiber fabric, causing mechanical entanglement of fibers.

According to an embodiment, the non-woven fiber fabric, or textile, consists of fibers having low friction and high strength. For example, according to various embodiments, the bonded non-woven fiber fabric may consist of or comprise material, singly or in combination, from a group of materials comprising, or consisting of, UHMW-PE (Ultra High Molecular Weight PolyEthylene), LCP PET (Liquid Crystal Polymer PolyEthylene Terephthalate), PEEK (Polyether Ether Ketone), PBO (p-phenylene-2,6-benzobisoxazole), PTFE (PolyTetraFluoroEthylene) and siliconized PET (PolyEthylene Terephthalate).

The materials of which the invention makes use are described in the following section.

BRIEF DESCRIPTION OF DRAWINGS

Embodiments of the invention will now be described, by way of example, with reference to the accompanying drawings, wherein.

Figure 1:
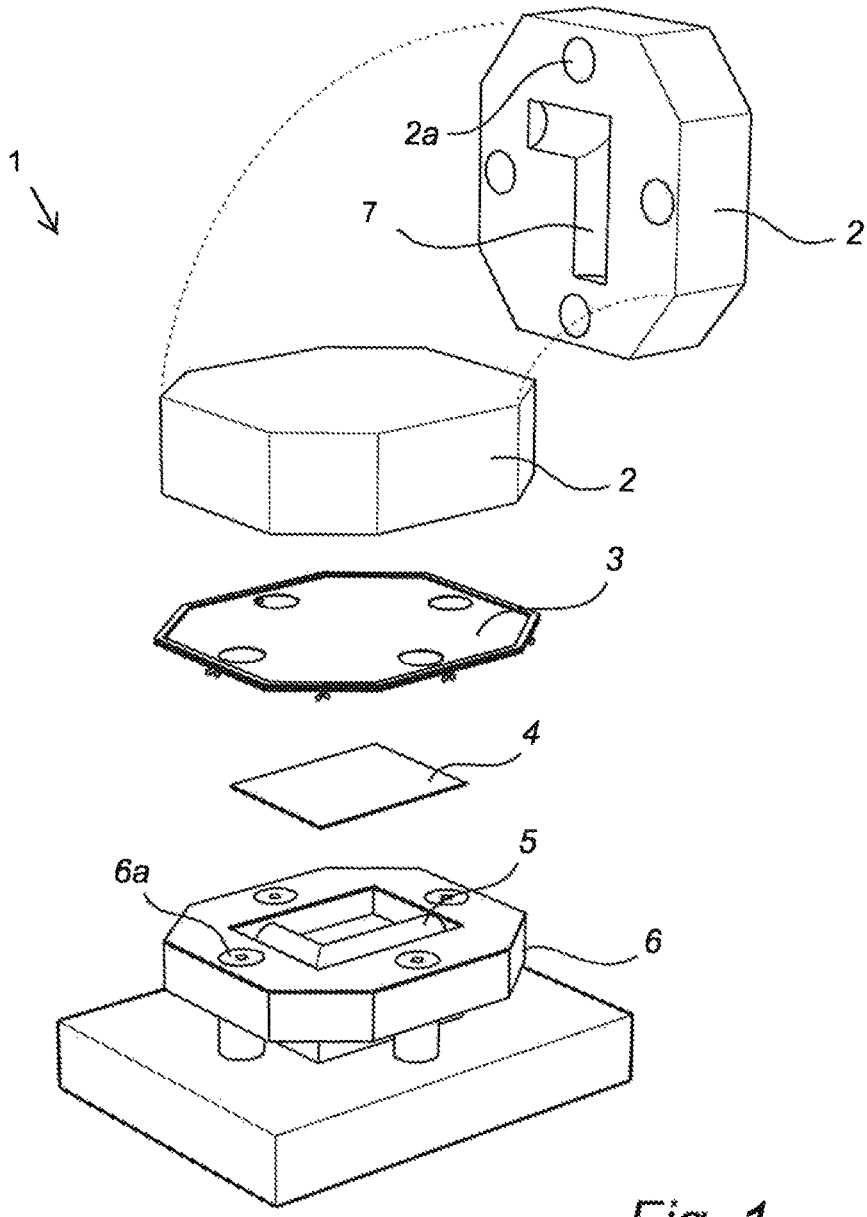
FIG. 1 is a schematic, partly exploded, perspective view of an embodiment of a tool arrangement for metal working arranged to form a workpiece during a working process, according to the present invention.

It should be understood that the drawings are not true to scale and, as is readily appreciated by a person skilled in the art, dimensions other than those illustrated in the drawings are equally possible within the scope of the invention.

DESCRIPTION OF THE INVENTION

One embodiment of the invention consists of the following parts:

One or more draped tools for sheet metal forming, in which non-woven textile is used as the protective layer between sheet metal and tool, inter alia for deep drawing and other forming of complex three-dimensional geometries.

One embodiment of the invention comprises the fastening of specially adapted textiles, for forming, to the tools.

Draped tools can replace the use of lubricant in the forming operation, including in the forming of sheet metal which has an adhesive effect on the tools, for example stainless steel sheet metal, titanium and aluminum.

Draped tools can also be used in the pressing of galvanized sheet metal. Typical problems which arise are galvanized slip at drawing radii and beads. Where fabric is used, this can be replaced once it has become contaminated by the Zn layer.

As a result of the protective textile layer, the surface finish of the sheet metal product can remain unaffected by the forming process.

The protective effect also allows ready-lacquered sheet metal to be able to be deep drawn without marks or scratches in the lacquer.

The demands upon the tool surfaces become less when they are protected by textile. Draped tools can be used without surface coating and it is extremely likely that significantly rougher tool surfaces can be used than is normal. Somewhat rougher tool surfaces can even be an advantage, since they can prevent sliding and creasing of the textile during forming. Lower surface requirements lessen the need for time-consuming and costly manual labor in tool production.

The invention also leads to possible minimization of tool maintenance and washing, something which is particularly important in the forming of sheet metal which produces adhesive wear upon the tools, for example stainless steel sheet metal, titanium, aluminum and galvanized sheet metal.

Energy consumption and chemicals consumption is reduced. Sheet metal parts can be formed wholly without lubricant. This both reduces the use of environmentally harmful substances and eliminates the need for a subsequent process to wash away the lubricant, which can yield large energy savings.

The internal environment is improved by less oil and lower noise level in the press operation. The lower noise level is a result of the soundproofing effect of the textiles.

Different sheet metal thicknesses can be pressed in the same tool, which is adapted by the use of textiles of different thickness.

In FIG. 1, an embodiment of a tool arrangement 1 for metal working which is arranged to form a workpiece 4 during a working process, such as a cold metal forming process, is illustrated. The arrangement comprises a first tool 2 comprising a first forming surface 7. A protective layer 3 formed of a bonded non-woven fiber fabric is arranged between the forming surface 7 and the workpiece 4 in order to protect the tool and/or the workpiece during the working operation. As illustrated, the tool arrangement 1 further comprises a second tool 6 comprising a second forming surface 5 having a shape corresponding to and being arranged to cooperate with the first forming surface 7, wherein the workpiece is pressed and formed between the first and second forming surfaces 7 and 5. As further shown, the first tool 2 comprises alignment openings 2*a* arranged to cooperate with alignment members 6*a* of the second tool 6, as illustrated in FIGS. 2*a*-2*c*.

According to various embodiments of the tool arrangement 1, it may form part of a mechanically and/or hydraulically driven metal press arrangement, which may further comprise a punch and a die member. According to an embodiment, with reference to FIG. 1 the first tool 2 may form the die and the second tool 6 may form the punch, which are arranged for cold forming operation, wherein the punch and die each comprises a corresponding forming surface arranged to cooperate with each other.

Figure 2A:
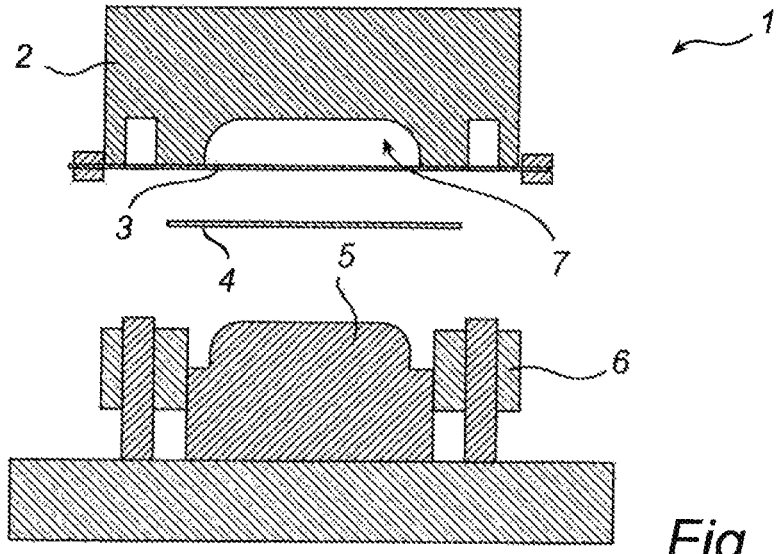
FIGS. 2*a*-2*c* are schematic views of different metal forming steps of an embodiment of a tool arrangement for metal working according to the present invention.
Figure 2B:
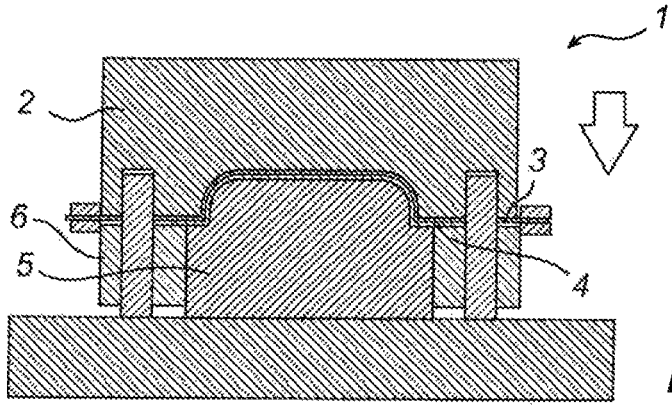
Figure 2C:
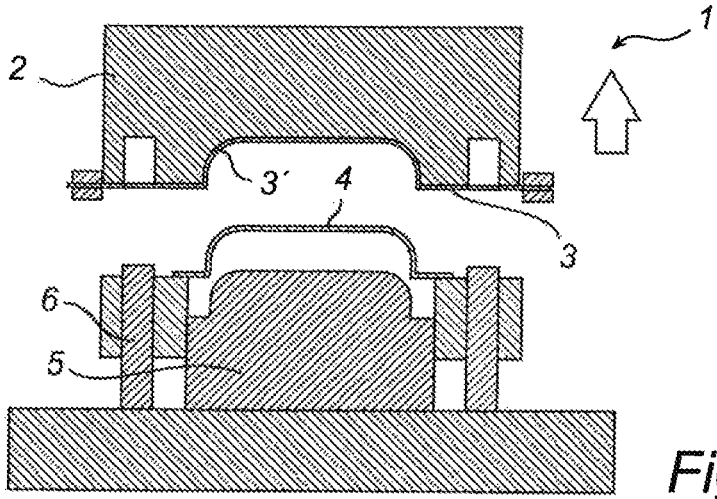

With reference to FIGS. 2*a*-2*c*, a tool arrangement 1 arranged as described with reference to FIG. 1 if not stated otherwise, is illustrated during different metal forming process steps. In this embodiment, the forming surface 5 is arranged to extend out from the second tool 6, into an inwardly extending cavity in the first tool 2, which cavity defines the first forming surface 7.

In FIG. 2*a*, showing a first step, a sheet of protective layer 3 is provided in a flat outstretched configuration adjacent the first forming surface 7, between the first forming surface and a workpiece 4 formed of sheet metal. During the metal forming process, the first and second tools 2 and 6 are pressed together, as illustrated in FIG. 2*b*, wherein the second forming surface 5 are received into the cavity, or die, forming the first forming surface, such that the protective layer 3 and the workpiece are formed into the desired shape defined by the forming surfaces. The protective layer 3 may also be shaped by itself in a pre-manufacturing pressing step performed without a workpiece 4. For example, during operation, a coefficient of friction between the protective layer and the workpiece is between 0.05 and 0.3, or between 0.1 and 0.2, which ensures efficient forming of the workpiece with high quality results.

With reference to FIG. 2*c*, the first and second tools 2 and 6 have been separated and the formed workpiece has been replaced with an additional non-formed workpiece to be formed in a second forming step using the same protective layer 3. As shown, the protective layer 3 has been reshaped to fit the first forming surface and remains in this shape by being a self-supportive structure. The first tool 2 thereby forms a draped tool being covered by the protective layer 3 according to an embodiment of the present invention. During the reshape step of the protective layer 3, at least a portion, such as stretch out portion 3' of the protective layer 3, has been stretched out to conform to the first forming surface 7.

Figures 3A, 3B, 3C, 3D:
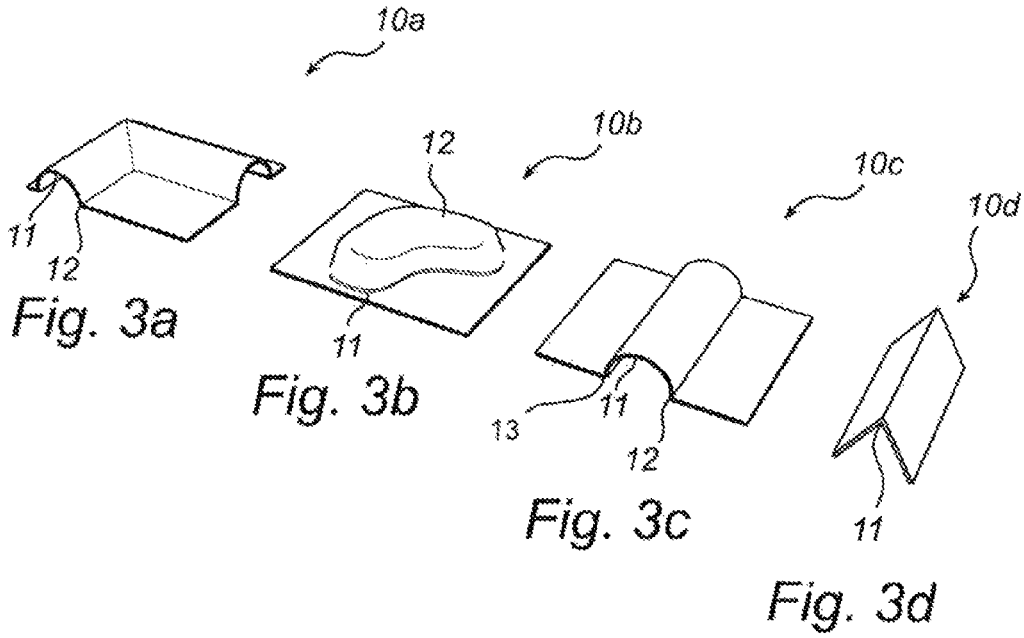
FIGS. 3*a*-3*d* are schematic perspective views of alternative metal workpieces formed in a metal forming process.

For example, as shown in FIGS. 3*a*-3*c*, exemplifying workpieces 10*a*, 10*b*, or 10*c*, each having a three-dimensional pattern or shape, may be formed by the tool arrangement or the method for working metal. As illustrated, the three-dimensional shapes comprises a double curvature profile, i.e. a cross-sectional profile comprising at least a first bend 11 and a second bend 12. For example, the first and second bends are directed in at least partly opposite directions in relation to each other. Also, the first and second bends 11 and 12 may have different radius of curvature. As further shown, the shapes 10*a*, 10*b*, 10*c* comprise further bends, such as third bend 13, shown in FIG. 3*c*. In comparison, the workpiece shape illustrated in FIG. 3*d* of workpiece 10*d* has a three-dimensional shape comprising only a first bend 11.

Also, as shown in FIGS. 3*a* and 3*b*, the formed three-dimensional pattern or shape of the workpiece 10*a* or 10*b* forms a complex three-dimensional shape which comprises at least two different double curvature surfaces which are different from each other. In other words, these complex three-dimensional shapes do not have a constant cross-sectional profile along any geometrical straight line passing through the three-dimensional formed workpiece, from one end to the opposite end of the formed workpiece. For example, in comparison, as in the case of the shape of the formed workpiece 10*c* illustrated in FIG. 3*c*, which has a constant cross-sectional profile in a direction along the full length of the formed workpiece 10*c*.

The protective textile consists of non-wovens, which predominantly consist of fibers produced from UHMW-PE (Ultra High Molecular Weight PolyEthylene). Non-wovens is a collective term for the production of textile materials which are not produced by weaving, knitting or other methods which require continuous yarn or thread for production. Various examples of non-woven materials which can be used in the invention are listed below under "types of non-wovens".

A non-woven fabric lasts for a relatively large number of pressings before it needs to be changed. Even in the forming of complex parts with heavy deep drawing, the fabric can be used for so many parts before becoming worn through that the cost per part is lower than in forming with lubricant.

Non-wovens can be produced in large widths which cover all occurring sheet metal sizes.

Non-woven materials can be specially adapted to different forming geometries, tool surfaces and sheet metal surfaces by the production of textile with specified properties, such as wear resistance and friction.

The technique involving draped tools can be utilized for local adaptation of the tribological properties in the tools. In certain parts, the textile can be provided with low or high friction in order to facilitate or deter material transport of sheet metal during forming. Low friction can also be used to reduce the temperature in heavily stressed parts of the tool and, at the same time, avoid high temperatures which break down the fibers of the textile. Another way of controlling the forming process can be the elongation properties of the textiles. These can be made direction-dependent, which can affect how the sheet metal is formed during the process.

There is also the potential to create adaptive sheet metal forming processes. Nowadays sensors can be integrated in the layer, for example in the form of conductive fibers. With the aid of these sensors, information such as pressure, temperature, elongations, friction, etc. could be gathered in real time from different parts of the tool. The fact that the textiles are located in the contact between tool and sheet metal allows the information to be used for process control, in which transmitter signals are used to control process data such as pressing forces.

The textile can be provided with transmitter functions, which can be used to measure and quality control the process employed in sheet metal forming. An adaptive forming process can be used to reduce the reject rate, increase the product quality and reduce the tool wear and maintenance costs.

Draped tools can also form part of an adaptive tribological system, in which the friction properties can be controlled locally and in real time during the actual forming process. This can be realized by the conduction of a current through the fabric and the creation of a voltage field which can control the viscosity of the lubricant through the integration of polar, anisotropic components.

Types of Non-Wovens

The production of non-wovens can be schematically divided into fiber forming and fiber bonding. Fiber forming can be realized with three different principles, drylaid, wetlaid and airlaid. By drylaid is meant, above all, carding or variants thereof, in which the fibers are oriented mechanically into pile. Wetlaid, as the name indicates, is a wet process, in which the fibers are mixed together and distributed in the wet state (similar to paper production), and airlaid is realized by the fibers being mixed together in air currents and sucked down onto a forming wire.

Textile materials are produced from thin fibers. Woven and knitted textiles are produced from threads, which, in turn, are built up from fibers. Non-woven material, or bonded fiber fabric as it is sometimes called, is produced directly from fibers. There is commercial production of fibers consisting of PTFE and UHMW-PE, which are used, inter alia, in applications in which low friction is desirable. Fibers of PTFE are often used in products which require extreme chemical resistance, but in which the mechanical properties are subordinate. Fibers of UHMW-PE are used almost exclusively on the basis of the extremely high mechanical properties and where the maximum usage temperature is lower. UHMW-PE also has high chemical resistance and low friction. Fibers of UHMW-PE have about 97% crystal structure and only 3% amorphous structure. Since the crystals also are very long and oriented in the fiber direction, these fibers acquire a substantially higher thermal conductivity than the majority of polymer-based fibers. The high thermal conductivity is believed to be a strong contributory factor to the positive results obtained with these fibers.

Ultra high molecular weight crystalline polyethylene (UHMW-PE) is a material which has found increased use in applications which require any of the following properties: high strength, good thermal conduction, low friction and low weight. Despite its low melting temperature around 144-152° C. and maximum usage temperature around 120° C., it has found use in sintered form as surface coating in which low friction is desired. The friction of UHMW-PE is comparable with PTFE, but is in fiber form many times stronger with a breaking point of about 3000 MPa. UHMW-PE also conducts heat much better due to its high crystallinity.

There are several producers of commercial UHMW-PE. The world's leading producer of this type of fibers is the Dutch company DSM, with the trademark Dyneema. Honeywell in the USA produces corresponding fibers under the brand name Spectra. The Japanese company Toyobo also produces fibers in a joint venture together with DSM, under the trademark Dyneema. There are also a number of Chinese producers, who, with mixed success, have started fiber production of UHMW-PE. The tensile strength of the fibers is higher than para aramid (Kevlar, Twaron), but from the strength aspect it is compressive strength, shearing strength and abrasion which stand out most compared with para aramid. The friction for UHMW-PE is somewhat lower than for PTFE, generally known under the trademark Teflon from DuPont.

Liquid Crystal Polymer PolyEthylene Terephthalate (LCP PET) fiber is almost as strong as UHMW-PE, but has a much higher melting point. These fibers, however, have higher friction. Siliconized PET fiber has friction of the order of UHMW-PE, but lower strength. It is also possible to mix different fibers together in one textile. It is possible, for example, to mix in a small component of more lightly processed fiber, such as siliconized PET fiber, with UHMW-PE in order to improve the producibility of the textile.

A fiber which is to act as dry lubricant needs to have properties such as low friction and, in a wider sense, high strength. It is the combination of these two properties—strength and low friction—which, together with the non-woven construction of the fabric, is expected to provide the preconditions for the deep drawing and stretch pressing of the sheet metal material without lubricant.

There is a fiber type which has both extremely low friction (comparable with PTFE=polytetrafluoroethylene, Teflon) and extremely high strength, and which is made of UHMW-PE (DSM Dyneema, Honeywell Spectra, etc.). When this fiber type is used predominantly in the production of textile for draping in tools in combination with the described production process, the combination of properties which is required, namely formability, low friction and mechanical resistance to the pressing, is obtained.

Another fiber with interesting properties is Liquid Crystal Polymer PolyEthylene Terephthalate (LCP PET), which is almost as strong as UHMW-PE but has a much higher melting point. These fibers, however, have higher friction. Finally, siliconized PET fiber (PolyEthylene Terephthalate) has also been considered interesting. The fiber has friction of the order of UHMW-PE, but lower strength.

Depending on production requirements and desired property profile, fibers, for example siliconized polyester fiber, or fibers of LCP-PET (Vectran), PTFE (polytetrafluoroethylene, Teflon) or PEEK (Polyether Ether Ketone, for example Zyex), can be mixed in. The abrasion resistance can be increased if Dyneema has been combined with 20% siliconized PET (for example Wellman M700). Other fiber types can also be incorporated in lesser measure in order to facilitate the carding process. One example is PBO Poly (p-phenylene-2,6-benzobisoxazole).

It should be noted that the invention has mainly been described above with reference to a few embodiments. However, as is readily appreciated by a person skilled in the art, other embodiments than the ones disclosed above are equally possible within the scope of the invention, as defined by the appended patent claims.

It is further noted that, in the claims, the word "comprising" does not exclude other elements or steps, and the indefinite article "a" or an does not exclude a plurality. A single apparatus or other unit may fulfill the functions of several items recited in the claims. The mere fact that certain features or method steps are recited in mutually different dependent claims does not indicate that a combination of these features or steps cannot be used to an advantage.

The invention claimed is:

1. A tool arrangement for cold metal working, comprising: a tool which has at least one forming surface, which is arranged to form a workpiece during a working process according to a three-dimensional pattern or shape comprising a first double curvature surface, wherein the forming surface of the tool is provided with a protective layer which is intended to be situated between the forming surface and the workpiece in order to protect the tool and/or the workpiece during the working process, wherein the protective layer comprises bonded non-woven fiber fabric, and wherein the bonded non-woven fiber fabric forming the protective layer comprises UHMW-PE (Ultra High Molecular Weight PolyEthylene) fibers.

2. The tool arrangement as claimed in claim 1, wherein the non-woven fiber fabric comprises at least 50% by weight of UHMW-PE fibers, or at least 60%, or at least 70% or at least 80%, or at least 90% by weight of UHMW-PE fibers.

3. A tool arrangement for cold metal working, comprising: a tool which has at least one forming surface, which is arranged to form a workpiece during a working process according to a three-dimensional pattern or shape comprising a double curvature surface, wherein the forming surface of the tool is provided with a protective layer which is intended to be situated between the forming surface and the workpiece in order to protect the tool and/or the workpiece during the working process, wherein the protective layer comprises bonded non-woven fiber fabric, and wherein the bonded non-woven fiber fabric is formed of fibers, or staple fibers, having a length between 20 and 100 mm, or between 40 and 80 mm, or between 50 and 60 mm.

4. The tool arrangement as claimed in claim 1, wherein the bonded non-woven fiber fabric is draped over the forming surface of the tool and arranged to be reshaped during the working process.

5. The tool arrangement as claimed in claim 1, wherein the protective layer is self supportive and shaped according to the forming surface during the working process.

6. A tool arrangement for cold metal working, comprising: a tool which has at least one forming surface, which is arranged to form a workpiece during a working process according to a three-dimensional pattern or shape comprising a double curvature surface, wherein the forming surface of the tool is provided with a protective layer which is intended to be situated between the forming surface and the workpiece in order to protect the tool and/or the workpiece during the working process, wherein the protective layer comprises bonded non-woven fiber fabric, and wherein the bonded non-woven fiber fabric has a weight between 50 and 1000 grams per square meter, or between 100 and 400 grams per square meter, or between 200 and 300 grams per square meter.

7. The tool arrangement as claimed in claim 1, wherein the three-dimensional pattern or shape comprises a second double curvature surface being different from the first double curvature surface.

8. A method for cold working of metal, in which a workpiece is formed in a working process according to a three-dimensional pattern or shape comprising a double curvature surface with a tool which has at least one forming surface, wherein the forming surface of the tool is provided with a protective layer comprising bonded non-woven fiber fabric, the protective layer being arranged between the forming surface and the workpiece in order to protect the tool and/or the workpiece during the working process, wherein the bonded non-woven fiber fabric forming the protective layer comprises UHMW-PE (Ultra High Molecular Weight PolyEthylene) fibers.

9. The method according to claim 8, further comprising shaping the bonded non-woven fiber fabric during the working process, wherein at least a portion of the protective layer is stretched out such that the protective layer conforms with the forming surface.

10. The method according to claim 9, wherein the protective layer is shaped into a self-supportive structure corresponding with the forming surface of the tool.

11. A method for cold working of metal, in which a workpiece is formed in a working process according to a three-dimensional pattern or shape comprising a double curvature surface with a first tool which has at least one forming surface, wherein the forming surface of the first tool is provided with a protective layer comprising bonded non-woven fiber fabric, the protective layer being arranged between the forming surface and the workpiece in order to protect the first tool and/or the workpiece during the working process, the method including a first step in which the protective layer, initially having an essentially flat shape, is compressed and between the forming surface of the first tool and the workpiece, or between the forming surface of the first tool and a second tool, such that the protective layer is reshaped to conform with the forming surface.

12. The method according to claim 11, further comprising a second step in which an additional workpiece to be formed in the working process is formed according to the three-dimensional pattern or shape with the first tool, wherein the same reshaped protective layer is arranged between the forming surface and the workpiece in order to protect the first tool and/or the workpiece during the working process.

13. The method according to claim 12, in which the second step is repeated a number of times for a plurality of separate workpieces or forming operations.

* * * * *